United States Patent [19]

Boda

[11] Patent Number: 4,499,780

[45] Date of Patent: Feb. 19, 1985

[54] ADJUSTABLE CONTROL LINKAGE

[75] Inventor: James C. Boda, Winneconne, Wis.

[73] Assignee: Brunswick Corporation, Skokie, Ill.

[21] Appl. No.: 414,117

[22] Filed: Sep. 2, 1982

[51] Int. Cl.[3] ..... G05G 9/00; F02N 17/00

[52] U.S. Cl. ..... 74/107; 74/522; 74/569; 123/187.5 R

[58] Field of Search ..... 261/DIG. 8; 123/187.5 R, 413; 74/522, 525, 522.5, 569, 567, 526, 104, 107

[56] References Cited

U.S. PATENT DOCUMENTS

| | | | |
|---|---|---|---|
| 1,084,514 | 1/1914 | Whitlock | 74/104 |
| 1,454,929 | 5/1923 | Irwin | 123/187.5 |
| 1,625,572 | 4/1927 | Simpson | 261/DIG. 8 |
| 1,934,953 | 11/1933 | Suiter | 74/501 A |
| 2,245,852 | 6/1941 | Castle | 74/526 X |
| 2,744,736 | 5/1956 | Evinrude | 261/34 A |
| 2,924,313 | 2/1960 | Binder et al. | 74/526 X |
| 2,979,172 | 4/1961 | Eshbaugh et al. | 74/526 X |
| 3,228,254 | 1/1966 | Biesecker | 74/104 |

*Primary Examiner*—Kenneth J. Dorner
*Assistant Examiner*—Rodney M. Lindsey
*Attorney, Agent, or Firm*—O. T. Sessions

[57] ABSTRACT

A control linkage has levers for actuating the throttle lever of a carburetor and a primer pump. A slide actuator has cam grooves engaging ends of the levers to actuate the levers in response to movement of the slide actuator. An adjustable linkage is provided on the end of the lever to allow adjustment of the linkage without the use of tools. The adjustable link has an adjustment arm formed integrally with the lever and ratchet teeth on the arm and lever engage to allow adjustment.

12 Claims, 4 Drawing Figures

ADJUSTABLE CONTROL LINKAGE

DESCRIPTION

1. Technical Field

This invention relates to motion transmitting linkages and particularly to such linkages which are adjustable and may be assembled without the use of tools.

2. Background Art

Prior linkages such as that disclosed in U.S. Pat. No. 2,744,736 have provided multiple functions controlled by a single actuator. The known prior linkages, however, have been expensive to fabricate, difficult to assemble and difficult to adjust.

DISCLOSURE OF INVENTION

The present invention is particularly directed to an adjustable linkage for controlling engine function. The linkage of the invention includes a bracket, a first link having a first end pivotally connected to the bracket and a second having a pivot means, and a second link pivotally attached to the pivot means. An adjustment means is formed integrally with the first link to provide a way to adjust the position of the pivot means on the first link.

The adjustment means can include a first set of ratchet teeth on the first link and an arm extending from the first link. A second set of ratchet teeth for engaging the first set of teeth are formed on the arm. The arm includes a relatively thin section to permit bending and bias the second set of teeth toward the first set of teeth. The pivot means is formed near the end of the arm. This arrangement allows the position of the pivot means to be adjusted by sliding the ratchet teeth past each other until the desired position is reached.

Conveniently a pair of gripping surfaces can be provided at opposite ends of the sets of ratchet teeth to allow the operator to adjust the position of the pivot means by merely squeezing the gripping surface. The invention may take the form of a slide member mounted for reciprocation on the bracket member, with a cam surface for actuating a lever pivotally connected to the bracket member. An integral adjustment means is provided on one end of the lever to adjust the position of a pivot means provided for connection to a control linkage.

An adjustment member having screw threads may extend through the slide member and abut against the bracket member at one end of the slide member's stroke to provide an adjustable limit to the stroke of the slide member. Preferrably, the adjustment member includes a spring arm, formed integrally with the adjustment member on its inner end. The free end of the spring arm faces away from the inner end of the adjustment member to allow the adjustment member to be easily assembled with the slide member and inhibit its removal.

A detent action can be provided for the slide member by forming a groove in either the slide member or the bracket member and providing a spring arm integrally with the other member. The spring arm has its free end biased toward engagement with the groove, thereby providing the detent action when the end of the spring arm engages the groove.

Assembly of the slide member with the bracket member is facilitated by another spring arm formed on the slide member. The spring arm is arranged to deflect as the slide member is inserted in the bracket, and act with a surface on the bracket member to limit the outward movement of the slide member once assembled.

A second lever can conveniently be attached to the bracket member by one or more C-shaped clip members formed on the bracket members. Cylindrical sections of the lever can thus be snapped into the clip members without using tools to provide the required pivotal attachment. The first lever may be pivotally mounted on the axis provided by the second lever.

The invention has the advantage of providing a mechanism with a minimum number of parts. No separate pieces are required to attach the major components together and no tools are required for assembly. Further, all of the components can be formed of injection molded plastic, thereby further reducing the cost of the device.

BEST MODE FOR CARRYING OUT THE INVENTION

Figure 2:
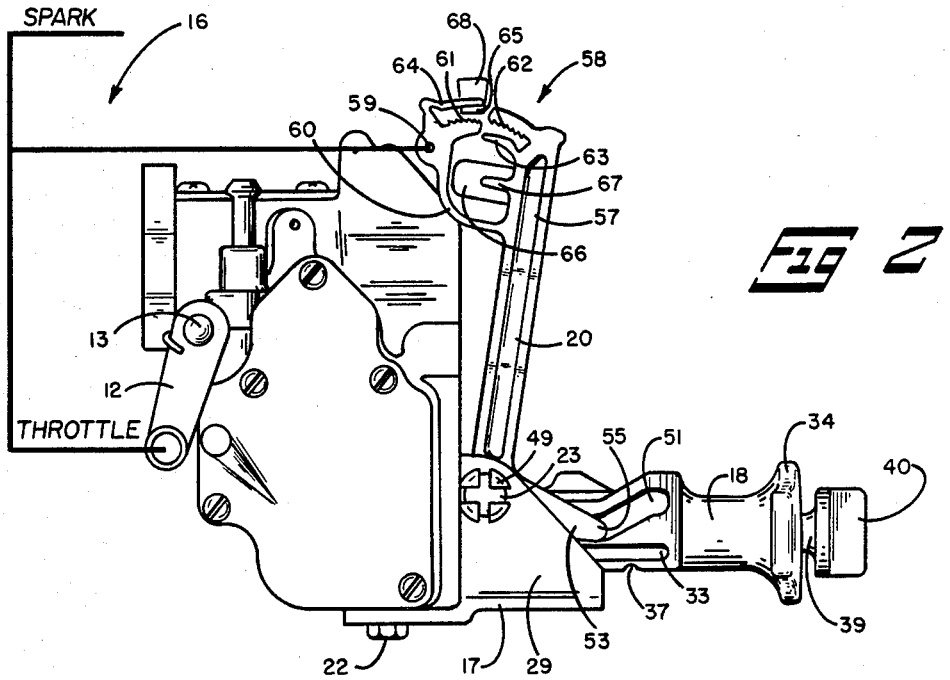
FIG. 2 is a left elevation of the linkage shown in FIG. 1.
Figure 3:
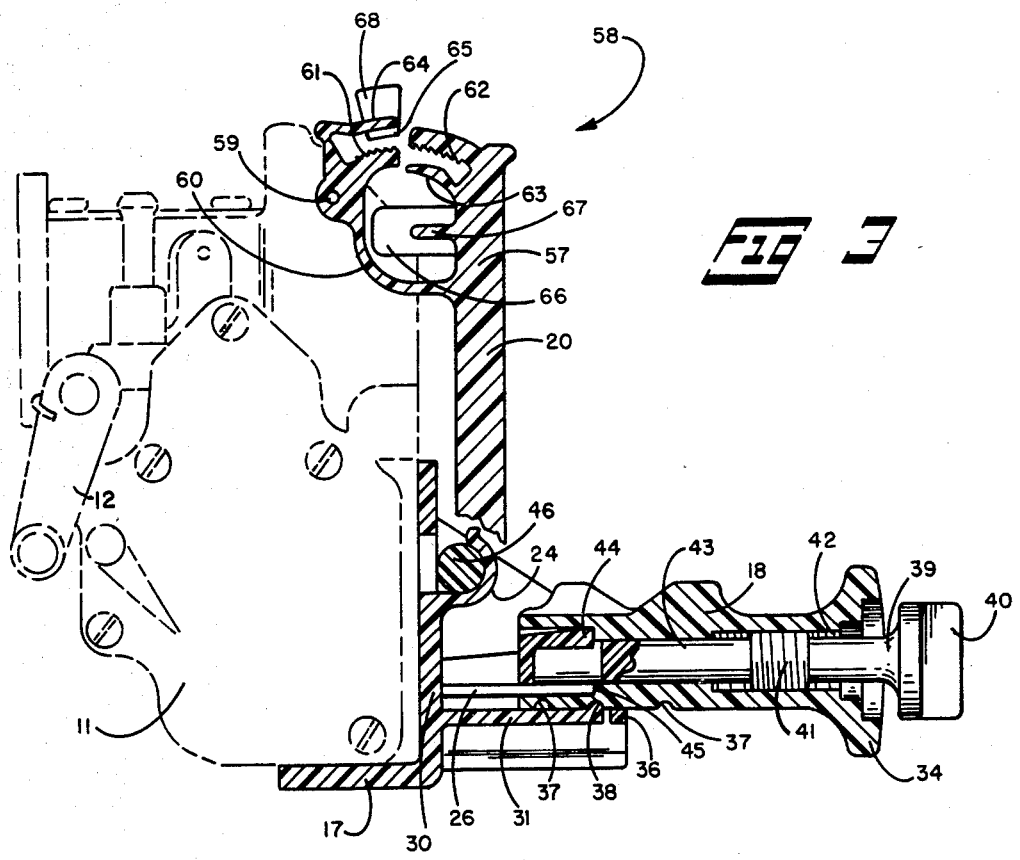
FIG. 3 is a sectional view showing detail of the linkage in FIG. 1.
Figure 4:
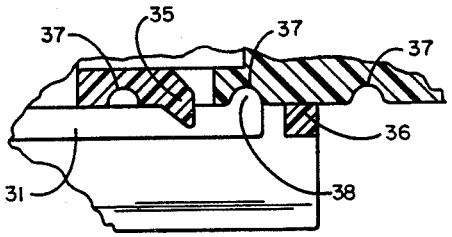
FIG. 4 is a bottom view of the device shown in FIG. 1.

Referring to the drawings, the adjustable control linkage 10 of the invention is shown mounted on a carburetor 11. The carburetor 11 includes a throttle valve, not illustrated, pivotally actuated by a lever 12 attached to the end of the throttle shaft 13. A primer pump 14 operated by a plunger 15 is included on the carburetor 11. The invention provides an adjustable control linkage for actuating both the primer pump plunger 15 and the throttle and spark advance linkage 16, schematically shown in FIG. 2 during starting and low speed operation of an engine, not illustrated, on which the carburetor 11 is mounted.

The control linkage 10 includes a mounting bracket member 17 on which a slide actuator member 18 and a pair of levers or links 19 and 20 are mounted. The bracket member 17 is fastened to the carburetor 11 by a pair of bolts 21 on the front and another bolt 22 on the bottom. A pivot hole 23 is formed on one side of the bracket 17 and a pair of C-shaped clips 24 and 25, one facing downward and the other facing upward are formed integrally with the bracket member 17 to provide pivotal mounting for the levers 19 and 20. A pair of opposing flanges 26 are provided on support arms 28 and 29 projecting forward from the mounting face 30 of the bracket member 17 to provide slide ways for the actuator member 18. An integral spring arm 31 also projects forward from the mounting face 30 between the flanges 26 to engage the bottom surface of the actuator member 18.

The slide actuator member 18 is reciprocally mounted on the opposing flanges 26 and 27 of the bracket member 17, with the opposing flanges 26 and 27 projecting into grooves 32 and 33 formed in the outside edges of the actuator member 18. A handle 34 is provided on its outward end for the operator's convenience. The actuator member 18 includes a pair of spring fingers 35 projecting downwardly and forwardly from the inward end of the actuator member 18 on opposite sides of the spring arm 31. The spring fingers 35 are depressed by a cross member 36 extending between the forward ends of the support arms 28 and 29 as the actuator 18 is initially engaged with the bracket member 17. When the fingers 35 pass the cross member 36 they snap down to provide a stop to prevent inadvertent removal of the actuator 18 from the mounting bracket 17. The actuator 18 can thus reciprocate on the ways provided by the opposing flanges 26 and 27 of the mounting bracket 17, with outward movement limited by the stops 35 and inward movement limited by the mounting face 30 of the bracket member 17. Three cross grooves 37 are formed on the bottom of the actuator 18 to be engaged by a lip 38 on the end of the spring arm 31 of the bracket member 17 to provide three detent positions for the actuator 18.

An adjustable screw member 39 is provided to adjustably limit the inward movement of the actuator 18. The screw member 39 is provided with a knob 40 on its outer end to allow convenient adjustment and has male screw threads 41 which engage female threads 42 provided in a bore 43 formed through the actuator 18. The inward end of the screw member 39 projects through the bore 43 to engage the mounting face 30 of the mounting bracket 17 and provide an adjustable limit to the inward movement of the actuator 18. A spring finger 44 is formed on the inward end of the screw member 39 to prevent its removal from the bore 43, the finger 44 engaging an annular surface 45 on the actuator member 18 when the screw member 37 is screwed to its outermost limit.

A primer lever 19 and an idle lever 20 are pivotally supported on the bracket member 17 to be driven by the slide actuator 18. The primer lever 19 includes a shaft 46 having a flange 47, while the idle lever 20 has a hole allowing it to be pivotally mounted on the primer lever shaft 46. The primer lever shaft 46 is snapped into place in the C-shaped clips 24 and 25 on the mounting bracket 17. The shaft 46 includes an end having an integral snap fastener 49 which is inverted through the hole in the idle lever 20 and the pivot hole 23 in the mounting bracket 17 to hold the shaft 46 axially in place. The idle lever 20 is thus held axially in place on the shaft 46 between the flange 47 and the mounting bracket 17.

The primer lever 19 and idle lever 20 are operated by a pair of cam grooves 50 and 51 formed in the opposite sides of the slide actuator 18. The primer lever 19 and idle lever 20 each have arms 52 and 53 including cam followers 54 and 55 which extend into the cam grooves 50 and 51 to be driven by the cam grooves 50 and 51 as the actuator 18 is moved. Both of the cam grooves 50 and 51 are open at the inward end of the actuator 18 to facilitate assembly. The primer lever 19 includes a second arm 56 on one end extending to engage the end of the primer plunger 15 and the idle lever 20 includes another arm 57 extending upward from the shaft 46.

An adjustable link 58 is formed on the end of the idle lever arm 57 to allow the operator to adjust the position of the hole 59 provided for connecting to the throttle linkage 16. The adjustable link 58 includes an adjustment arm 60 formed integrally with the idle lever arm 57 and having a relatively thin section to allow bending in a plane including the idle lever arm 57. A set of upwardly facing ratchet teeth 61 are formed on the end of the adjustment arm 60 to engage with the downwardly facing complementary teeth 62 formed on the end of the idle lever arm 57. Retaining arms 63 and 64 are formed on both the idle lever arm 57 and the adjustment arm 60 parallel to and spaced from the ratchet teeth 61 and 62 to hold the sets of teeth in engagement. A flange 65 is provided on the retaining arm 64 of the adjustment arm 60 to limit sideways movement of the adjustment arm 60 in one direction. Another flange 66 is formed on the idle lever arm 57 to engage the edge of the adjustment arm 60 and limit the sideways movement in the other direction. A stiffening ridge 67 is formed on the flange 66 to keep it from bending sideways. A tab 68 is also formed on the retaining arm 64 to allow the operator to bend the retaining arm 64 to disengage the flange 65, thus allowing the retaining arm 64 and ratchet teeth 61 to be moved sideways to disengage the sets of teeth. Finally, the hole 59 is provided near the end of the adjustment arm for attachment to the throttle linkage 16.

OPERATION

The adjustable control linkage 10 of the invention allows an operator to conveniently control both the idle speed and the primer pump operation by manipulating a single actuator member 18. To increase the engine idle speed setting for starting, the operator pulls the slide actuator 18 out, thereby causing the cam 51 on the actuator 18 to rotate the idle lever 20 and open the throttle on the carburetor 11. Approximately the first half of the actuator's stroke will move the idle lever 20 to its fully advanced position. The idle cam 51 is shaped to hold the idle lever 20 in its fully advanced position through the second half of the actuator stroke. If the engine is warm or has recently been run, the operator can leave the actuator 18 at the midpoint of its stroke, where it is held by the detent slot on the actuator 18, and commence starting the engine. If the engine is cold, the operator can pull the actuator 18 out to the end of its stroke, thereby actuating the primer plunger 15 to prime the engine. The engine may then be started with the actuator 18 all the way out and holding the plunger 15 depressed or with the actuator 18 returned to the midpoint, convenient if the plunger position controls an additional function such as a fuel passage in the carburetor 11.

The operator may also set the running idle speed at the desired level by turning the control knob 40 to limit the innermost position of the actuator 18, thereby also limiting the closure of the throttle.

Figure 1:
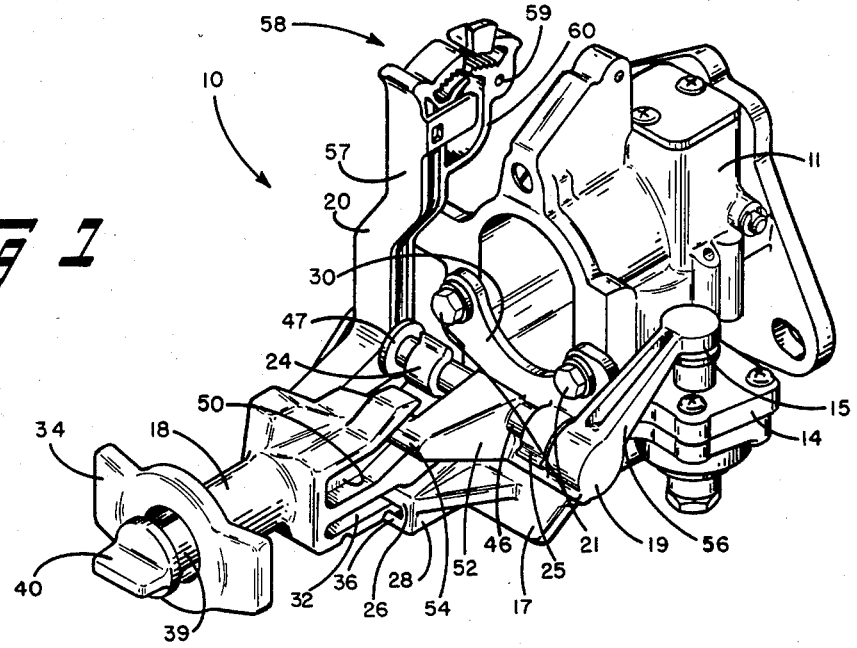
FIG. 1 is a perspective view showing the control linkage of the invention.

Finally, the adjustable link 58 on the idle lever 20 allows the linkage to be set to operate within an acceptable range of engine operating conditions. Typically, this adjustment would be made with the idle control knob 40 screwed all the way out. Thus the adjustable link 58 can be used to adjust the minimum engine idle speed which can be set by the idle control knob 40. Setting the adjustable link 58 is done by merely squeezing the adjustment arm 60 toward the idle lever arm 57 to increase the idle speed, with the ratchet teeth 61 and 62 holding the adjustment arm 60 in place. To reduce the idle speed setting, the operator disengages the ratchet teeth 61 and 62 by lifting up on the tab 68 and moving it to the right, as viewed in FIG. 1, until the teeth 61 and 62 are disengaged. The ends of the ratchet teeth 61 and 62 are then reengaged and the adjustment is made by squeezing the adjustment arm 60 toward the idle lever arm 57 until the desired setting is reached.

I claim:

1. An adjustable linkage for controlling engine function, said linkage including:

(A) a bracket;

(B) a first link having a first end pivotally connected to said bracket and having a second end including a pivot means;

(C) a second link pivotally attached to said pivot means; and (D) an adjustment means formed integrally with said first link for adjusting the position of said pivot means on said first link, said adjustment means including a first set of ratchet teeth on said first link and an arm extending from said first link with said pivot means located near an end of said arm, said arm including a second set of ratchet teeth for engaging said first set of ratchet teeth, said arm including a relatively thin section to permit bending and bias said second set of teeth toward said first set of teeth.

2. The linkage defined in claim 1 wherein said ratchet teeth extend generally parallel to said second link.

3. The linkage defined in claim 2 wherein said first link includes a pair of gripping surfaces at opposite ends of said sets of ratchet teeth to permit operator manipulation of said adjustment means.

4. An adjustable linkage for controlling engine functions, said linkage comprising:

(A) a bracket member;

(B) a slide member mounted for reciprocation on said bracket member, said slide member including a first cam surface thereon, said slide member further including a threaded passage therethrough, said passage having female screw threads and extending generally in the direction of reciprocation of said slide member;

(C) a first lever pivotally connected to said bracket member, said lever having a first end engaging said cam surface, a second end having a pivot means for attachment to a control linkage, and an adjustment means formed integrally with said lever for adjusting the position of said pivot means; and (D) an adjustment member, said adjustment member extending through said passage and including male screw threads engaging said female screw threads, one end of said adjustment member abutting against said bracket member when said slide member is at one end of its stroke, whereby said adjustment member serves to adjustably limit the inward travel of said slide member.

5. The linkage defined in claim 4 wherein said adjustment member further includes an integral spring arm on said one end, said arm having a free end facing away from said one end and projecting beyond said passage, to limit the outward movement of said adjustment member.

6. An adjustable linkage for controlling engine functions, said linkage comprising:

(A) a bracket member;

(B) a slide member mounted for reciprocation on said bracket member, said slide member including a first cam surface thereon; and (C) a first lever pivotally connected to said bracket member, said lever having a first end engaging said cam surface, a second end having a pivot means for attachment to a control linkage, and an adjustment means formed integrally with said lever for adjusting the position of said pivot means;

wherein one of said slide member and said bracket member includes a groove extending perpendicular to the direction of reciprocation of said slide member and the other of said slide member and said bracket member includes an integral spring arm having its free end biased toward engagement with said groove.

7. The linkage defined in claim 6 wherein said slide member further comprises a second integral spring arm having a free end formed on said slide member, the free end of said second spring arm acting with a surface on said bracket member to limit the outward movement of said slide member.

8. An adjustable linkage for controlling engine functions, said linkage comprising:

(A) a bracket member;

(B) a slide member mounted for reciprocation on said bracket member, said slide member including a first cam surface thereon;

(C) a first lever pivotally connected to said bracket member, said lever having a first end engaging said cam surface, a second end having a pivot means for attachment to a control linkage, and an adjustment means formed integrally with said lever for adjusting the position of said pivot means; and (D) a second lever pivotally attached to said bracket member, said slide member including a second cam surface and said second lever having a first end engaging said second cam surface.

9. The linkage defined in claim 8 wherein said bracket member further includes a first C-shaped integral chip member and said second lever includes a cylindrical section, said cylindrical section snapping into said clip to provide the pivotal connection between said bracket member and said second lever.

10. The linkage defined in claim 9 wherein said bracket member further includes a second C-shaped integral clip member, said second clip member aligned with said first clip member but opening in the opposite direction, and said second lever includes a second cylindrical portion, said second cylindrical portion snapping into said second clip member.

11. The linkage defined in claim 10 wherein said first lever includes a hole therethrough, one of said cylindrical portions extending through said hole to provide a pivot point for said first lever.

12. An adjustable linkage for controlling engine functions, said linkage comprising:

(A) a bracket member;

(B) a slide member mounted for reciprocation on said bracket member, said slide member including a first cam surface thereon; and (C) a first lever pivotally connected to said bracket member, said lever having a first end engaging said cam surface, a second end having a pivot means for attachment to a control linkage, and an adjustment means formed integrally with said lever for adjusting the position of said pivot means, said adjustment means including a first set of ratchet teeth on said lever and an arm extending from said lever, said arm including a second set of ratchet teeth for engaging said first set of ratchet teeth, said arm being bent to allow said ratchet teeth to engage and to bias said second set of teeth to engage said first set of teeth.

* * * * *